United States Patent [19]

Pew

[11] 4,415,202

[45] Nov. 15, 1983

[54] WHEELCHAIR ELEVATING APPARATUS ENABLING A USER TO LIFT HIMSELF FROM THE FLOOR TO A WHEELCHAIR SEAT

[76] Inventor: Melvin E. Pew, 211 Albert St., Washington, Ill. 61571

[21] Appl. No.: 314,753

[22] Filed: Oct. 26, 1981

[51] Int. Cl.[3] ..... A61G 7/08

[52] U.S. Cl. ..... 297/217; 5/81 R; 280/289 WC; 297/DIG. 4; 297/DIG. 10; 297/339; 297/347

[58] Field of Search ..... 297/339, 347, 310, 217, 297/DIG. 4, DIG. 10; 5/81 R, 84, 85, 88; 280/289 WC; 4/251

[56] References Cited

U.S. PATENT DOCUMENTS

| | | | |
|---|---|---|---|
| 2,821,242 | 1/1958 | Nanegold | 297/347 X |
| 3,076,678 | 2/1963 | Griffin | 297/339 |
| 3,123,400 | 3/1964 | Paulson | 297/347 X |
| 3,405,954 | 10/1968 | Wolfe | 280/289 WC |
| 3,925,833 | 12/1975 | Hunter | 4/251 |
| 3,938,820 | 2/1976 | Nabinger | 297/339 X |
| 4,010,499 | 3/1977 | Davis et al. | 5/81 R |
| 4,120,530 | 10/1978 | Imbro | 297/DIG. 4 |

*Primary Examiner*—James T. McCall
*Attorney, Agent, or Firm*—McCaleb, Lucas & Brugman

[57] ABSTRACT

A forwardly extending elevating frame is pivoted at the rear of a wheelchair main frame for vertical tilting movement. A leveling frame extends rearwardly from a pivot connection at the forward end of the elevating frame for relative vertical tilting movement. A pair of chains extend downwardly from a suspension bar on the main frame, engage a pair of sprockets supported on the elevating and leveling frames, and are trained in loops about idlers carried on the two tiltable frames. A lifting seat is supported on and forwardly of the leveling frame and is tiltable between a horizontal use position and a hanging stored position. Hand levers, accessible to a person on the lifting seat, are movable up and down to rotate the sprockets through pawl and ratchet connections. This causes the sprockets to climb the chains and elevate the person on the lifting seat to the level of the wheelchair seat. As the sprockets climb the chains, the chain loops lengthen to compensate for tilting of the elevating frame, thereby keeping the lifting seat level through its entire elevating range.

11 Claims, 9 Drawing Figures

Fig. 5.
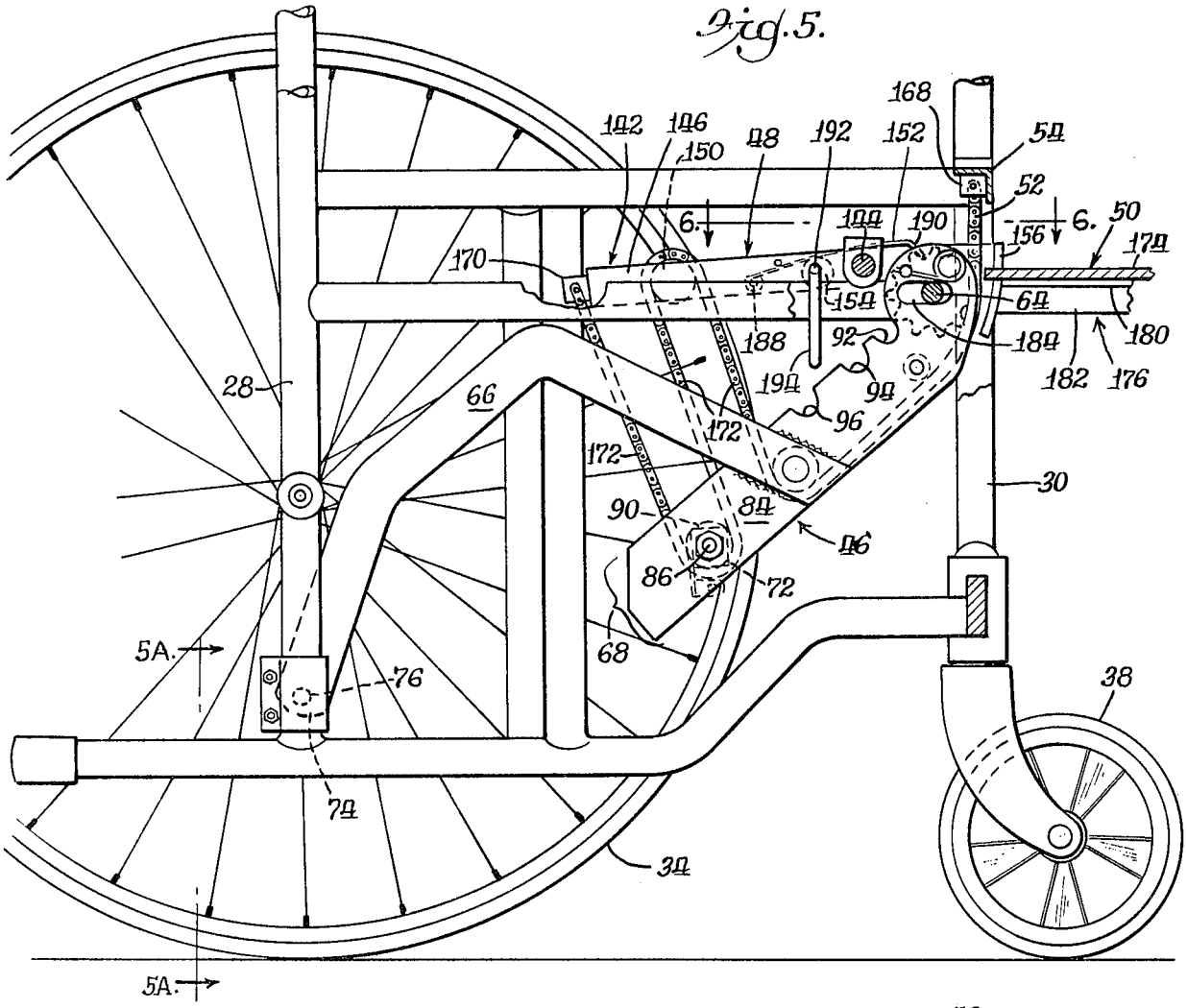
Fig. 6.
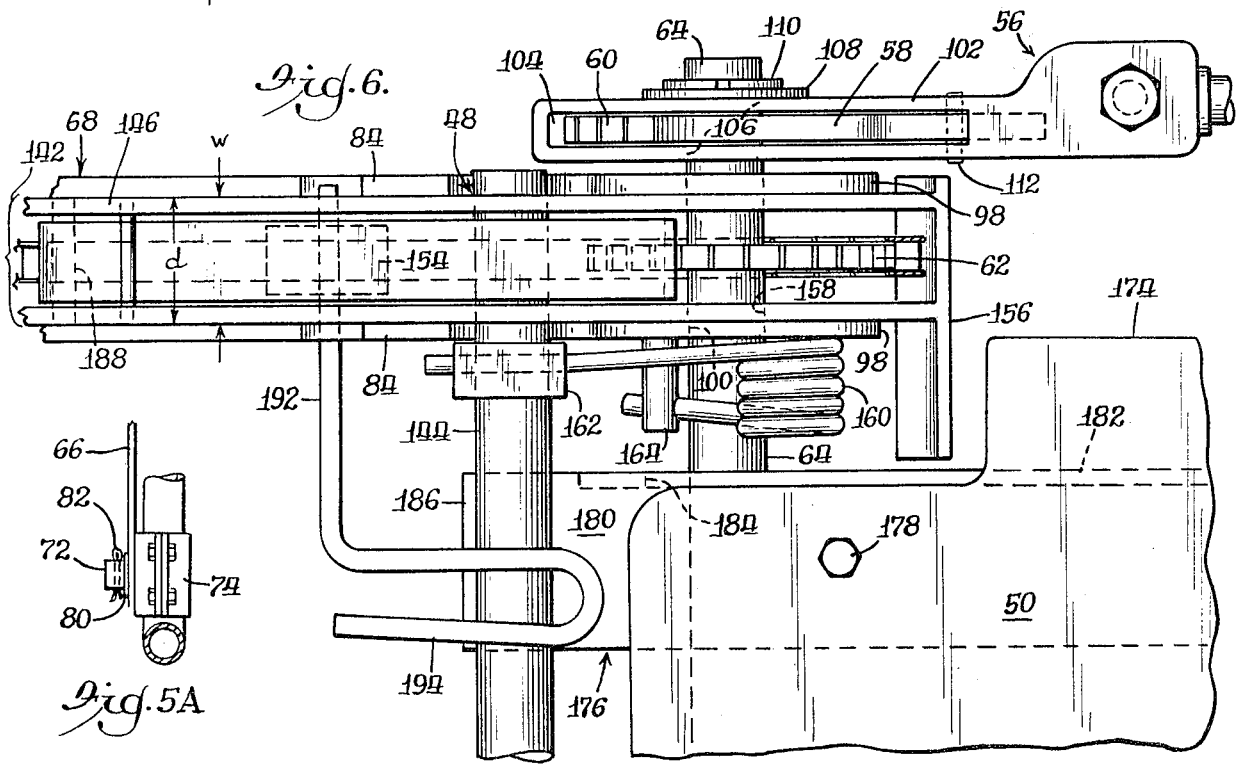
Fig. 5A

Fig. 7.
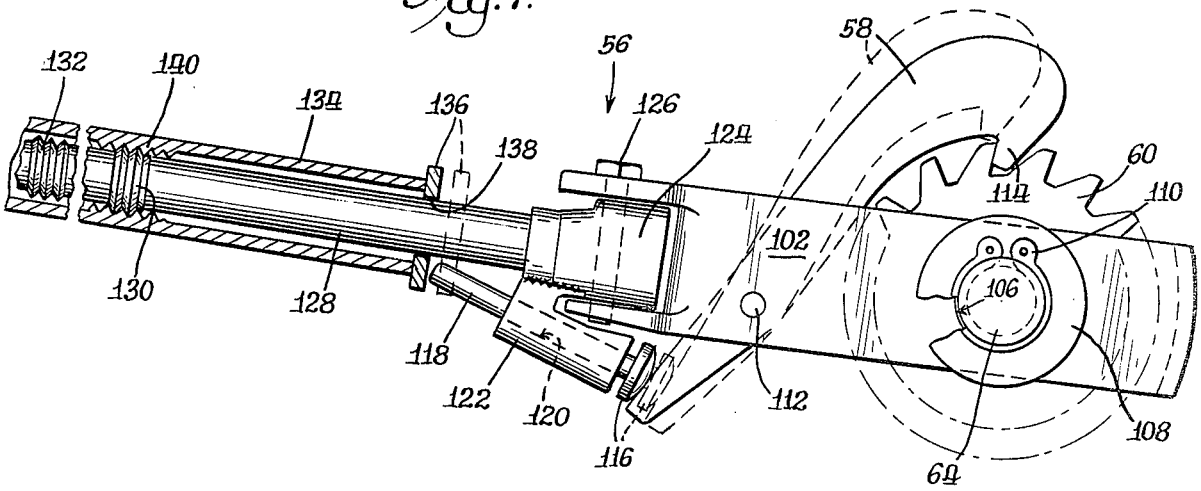
Fig. 8.
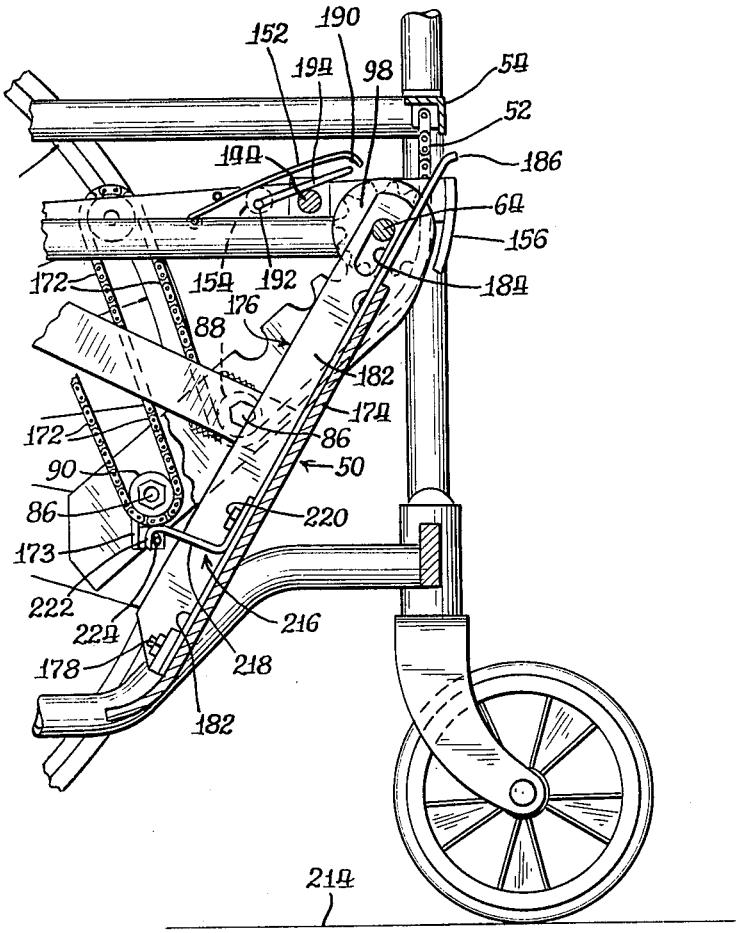
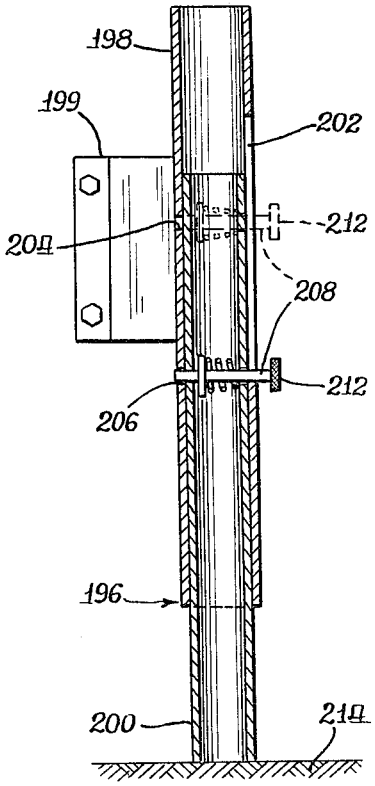
Fig. 9.

WHEELCHAIR ELEVATING APPARATUS ENABLING A USER TO LIFT HIMSELF FROM THE FLOOR TO A WHEELCHAIR SEAT

BACKGROUND OF THE INVENTION

This invention relates to wheelchairs and in particular to apparatus enabling a person who falls or slips from a wheelchair to elevate himself from the floor or ground and reseat himself in the wheelchair.

There have been cases where wheelchair occupants have fallen out of their wheelchairs while they were alone and were unable to reseat themselves because there was no one to help them. There have been instances where help did not arrive for hours or days.

This is a matter of grave concern to wheelchair users and their families.

SUMMARY OF THE INVENTION

A general object of the present invention is to provide elevating apparatus including an auxiliary, lifting seat which can be stored in an out of way position beneath a wheelchair seat until needed, and which the wheelchair user can manipulate to reseat himself in the event of a fall.

Another object is to provide such apparatus in the form of an attachment which can be fitted to a standard wheelchair. Alternatively, the apparatus may be incorporated as original equipment when a wheelchair is manufactured.

A specific object is to provide in such apparatus one or more lifting levers which are manually movable up and down to rotate sprockets supported by the elevating frame, causing the sprockets to climb chains fastened to the front of the wheelchair frame to thereby elevate the user on the auxiliary, lifting seat.

Another object is to provide in such apparatus a tiltable elevating frame with mechanism compensating for tilt of the elevating frame to keep the auxiliary, lifting seat in a level position through its entire range of vertical movement.

BRIEF DESCRIPTION OF THE DRAWINGS

Other objects and advantages will be apparent from the following description taken in connection with the drawings in which:

FIG. 5 is an enlarged, fragmentary vertical sectional view of FIG. 3;

FIG. 5A is an enlarged, fragmentary vertical sectional view of FIG. 5 taken on line 5A—5A;

FIG. 6 is an enlarged, fragmentary horizontal sectional view of FIG. 5 taken on line 6—6;

FIG. 7 is an enlarged, fragmentary view of one of the lifting levers shown in some of the previous figures, with its handle retracted;

FIG. 8 is an enlarged, fragmentary vertical sectional view of FIG. 4; and FIG. 9 is an enlarged, sectional view of one of the stabilizer legs shown in some of the previous views.

Like parts are designated by like reference numerals throughout the figures.

DETAILED DESCRIPTION OF THE PREFERRED EMBODIMENT

Figure 1:
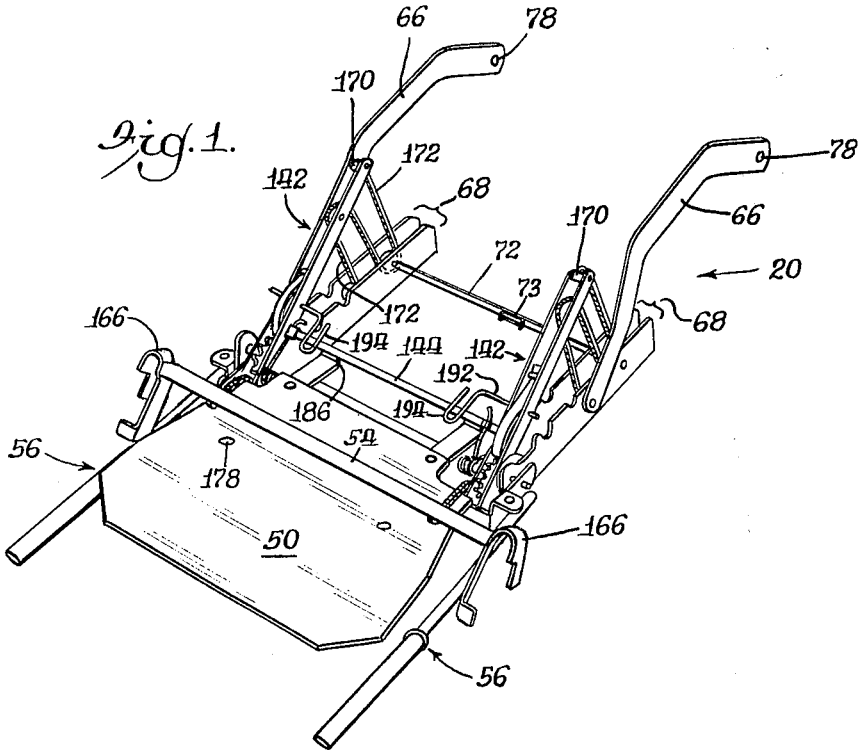
FIG. 1 is a perspective view of a preferred embodiment of the elevating apparatus, illustrated as a separate attachment which may be fitted on, and removed from, a standard wheelchair as needed.

Referring now to the drawings in more detail, elevating apparatus according to the present invention is illustrated as an attachment 20 which fits a standard wheelchair 22. As shown in FIG. 1, it can readily be transported, with a folded wheelchair, in an average size passenger automobile. Alternatively, a modification of the attachment 20 may be built into the wheelchair permanently, as original equipment.

The wheelchair has a main frame 24 with a foldable, canvas-like seat. Propelling and steering wheels 34, with hand rims 36, are rotatably supported on rear legs 28. Smaller caster wheels 38 are mounted on front legs 30. Foot rests 40 are pivotally mounted on curved tubes 42 which extend forwardly and downwardly from the front legs. By lifting on the seat straps 44, the wheelchair can be collapsed for transport. The above-described wheelchair construction is conventional so need not be described in further detail.

Major components of elevating apparatus 20 are: an elevating frame 46; a leveling frame 48; a lifting seat 50; a pair of chains 52, 52; a suspension bar 54; a pair of hand levers 56, 56; pawls 58, 58; ratchet wheels 60, 60; sprockets 62, 62; and a rotatable cross shaft 64.

The elevating frame 46 comprises a pair of curved levers 66, 66 and a pair of channel members 68, 68 interconnected by a tie bar 72. As shown in FIGS. 5 and 5A, the elevating frame is pivotally mounted on stub shafts 76 carried by brackets 74 on the rear legs. To assemble the attachment 20 on a wheelchair, it is necessary only to fit the openings 78 at the ends of the curved levers 66 over the stub shafts 76, and to fit the suspension bar 54 across the front ends of side frame members 32. The curved levers 66 are held on the stub shafts 76 by means of washers 80 and cotter pins 82 (FIG. 5A). Each channel member 68 comprises a pair of identical steel plates 84 held a fixed distance d apart by spacer bolts 86, 86 (FIG. 5). Chain guide idlers 88 and 90 are rotatably journaled about spacer bolts 86 between each pair of plates 84 in each channel 68. Recesses 92, 94 and 96 are provided along the top edge of each channel plate for clearance purposes when portions of the leveling frame 48 are nested within portions of the elevating frames 46 in the floor level position of FIG. 2. Each plate 84 has an arcuate forward end portion 98 with a circular opening 100. Cross shaft 64 is rotatably journaled within the openings 100.

As best shown in FIGS. 6 and 7, each hand lever 56 comprises a bar 102 with a slot 104 within which a pawl 58 and matching ratchet wheel 60 are positioned. Bar 102 has a central opening 106 through which shaft 64 extends and within which that shaft is rotatably journaled. Each bar 102 is held on the shaft by a washer 108 and C-spring retainer 110. Each pawl 58 is pivoted on a pin 112 in a corresponding bar 102. A tooth 114 at one end of each pawl is engageable with the teeth of a corresponding ratchet wheel 60. The opposite end of each pawl is engageable with the head 116 of a plunger pin 118 which is longitudinally slidably journaled in a bore 120 in a fitment 122 attached to a swivel fitting 124. The latter is pivoted to bar 102 by means of a pivot bolt 126. A rod 128 extends forwardly from fitting 124. It has separate rear and front groups of threads 130 and 132, respectively. A tubular handle 134 has a rear flange 136 with a bore 138 slidable along rod 128. The handle has a single threaded portion 140 which is optionally engageable with rear or front threaded portions 130 and 132 on the rod, enabling each handle 134 to be positioned optionally in a retracted or extended position as will now be described.

The hand levers 56 can be retracted by engaging handle threads 140 with rod rear threads 130 as shown in FIG. 7. Rotation of handle 134 from the solid line position to the broken line position of FIG. 7 moves flange 136 against plunger 118 and lifts pawl 58 to the broken line position disengaged from the ratchet wheel teeth. This enables the hand levers 56 to hang in retracted, stored position beneath the wheelchair seat as shown in FIG. 4.

Figure 2:
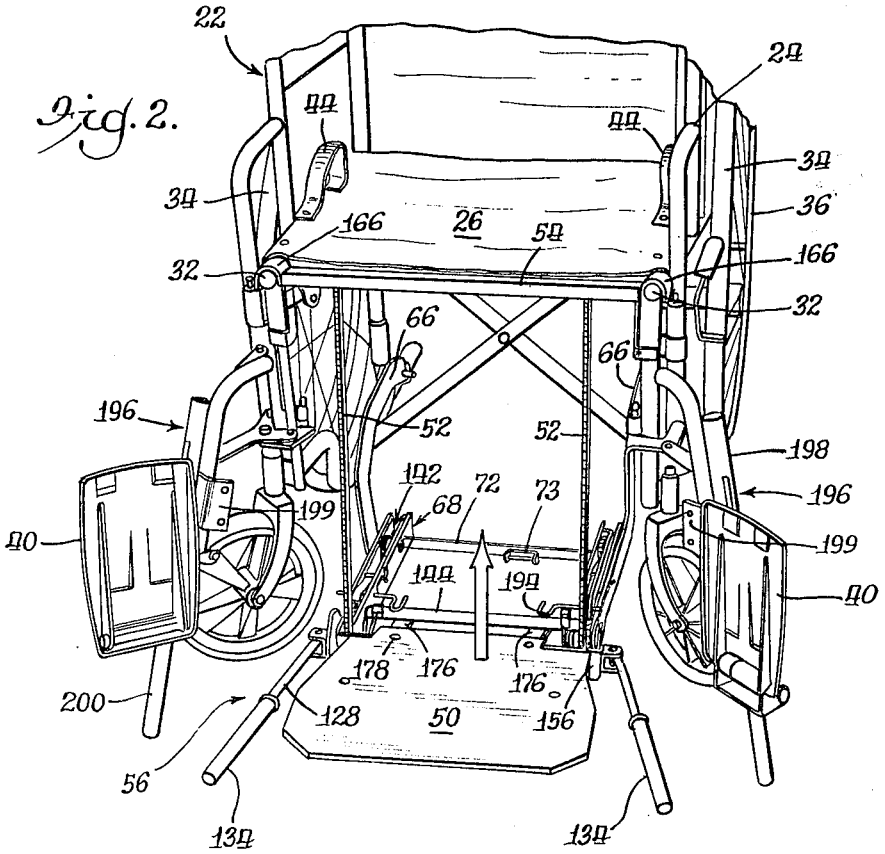
FIG. 2 is a fragmentary view of a wheelchair with the elevating apparatus of FIG. 1 fitted to it and being shown in floor level position ready for a user to raise himself on the auxiliary, lifting seat.

By turning the tubular handle 134 outwardly, disengaging handle threads 140 from inner rod threads 130 and re-engaging handle threads 140 with outer threads 132, each handle can be locked in an extended working position with the pawls 58 engaging the teeth of corresponding ratchet wheels 60 to raise the lifting seat 50 from the ground level position shown in FIG. 2.

The leveling frame 48 comprises a pair of channel members 142, 142 held a fixed distance apart by a tie rod 144. Each channel member 142 comprises a pair of identical plates 146 having an external width w (FIG. 6) narrow enough to nest in the space d between plates 84, 84 of channel members 68. The internal surfaces 148 of each pair of plates 146 are spaced far enough apart to provide room for a chain idler 150, a sprocket 62, a sprocket stop lever 152 and a cam 154. Sprockets 62 are fastened to opposite ends of cross shaft 64 and are centrally located within the respective leveling frame channel members, between the plates 146, 146, as best shown in FIG. 6.

Figure 4:
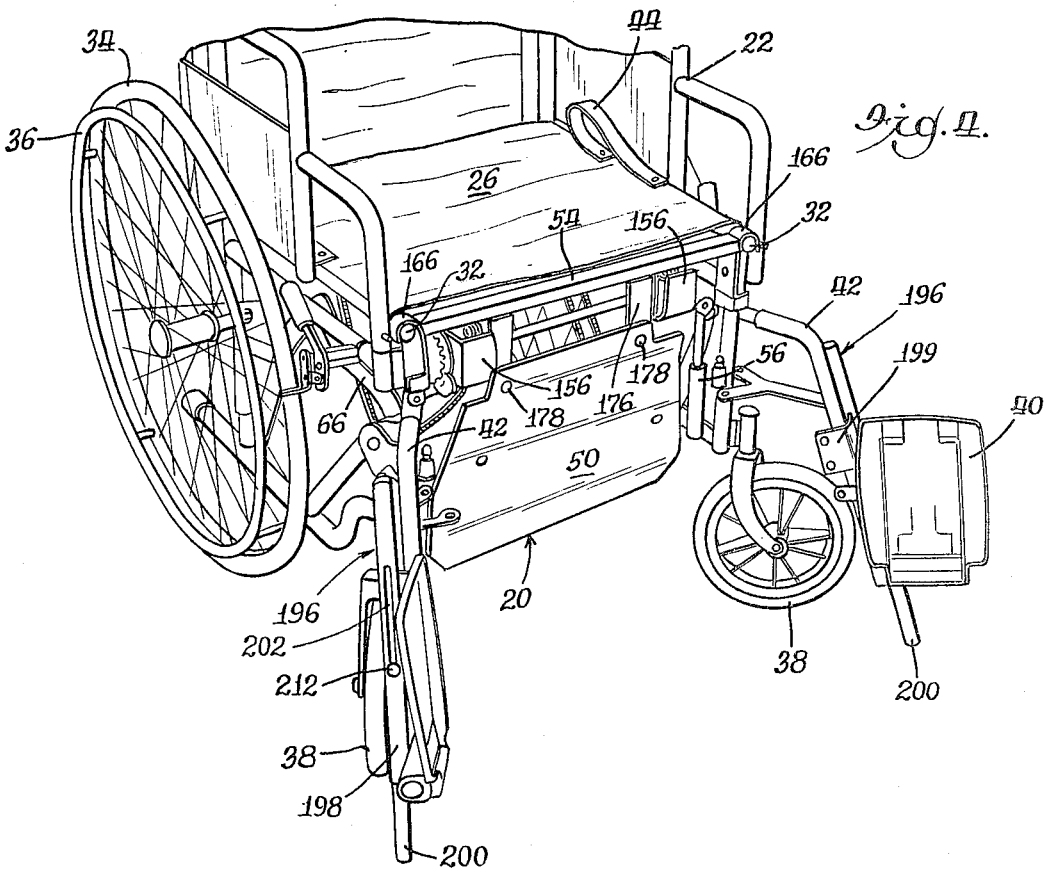
FIG. 4 is a view similar to FIGS. 2 and 3 showing the elevating apparatus in stored position beneath the wheelchair seat.

Referring to FIGS. 4 and 6, a curved vertical plate 156 is fastened across the front edges of plates 146 to protect the wheelchair user from injury by the chains or sprockets.

As best shown in FIG. 6, cross shaft 64 is rotatably journaled within openings 100 and 158 in plates 84, 84 and 146, 146 of the respective channel members 68 and 142. A torsion spring 160 is connected between spring bracket 162 on leveling frame tie rod 144, and a pin 164 on the adjacent elevating frame channel member 68. This biases the two frames apart to maintain lifting seat 50 level when there is no load on it; otherwise, when a person moves from the lifting seat 50 to the chair seat 26, the front of the seat would rise.

Suspension bar 54 has a pair of end saddles 166, 166 which fit over the forward end portions of side frame members 32. This is best shown in FIGS. 1–4. The front ends of chains 52 are supported on blocks 168 fastened to the underside of suspension bar 54. As best shown in FIG. 5, the chains 52 hang from the bar 54 and are trained successively around sprockets 62, idlers 88, 150, and 90, and are fastened at their rear ends to blocks 170 fastened across the rear ends of plates 146, 146 of the leveling frame 48. The idlers 88, 150 and 90 train the rear end portions of the chains in a plurality of loops 172 (FIGS. 1, 5 and 8).

The lifting seat 50 comprises a board or platform 174 mounted on a pair of longitudinal brackets 176. Each bracket is right angled in cross-section, having a flat body portion 180 fastened parallel to the bottom of the platform by bolts 178, and a flange or web portion 182. Each flange portion has an elongated slot 184 engaging cross shaft 64. Each bracket body portion 180 has an upturned rear end 186 which underlies and hooks behind the leveling frame tie rod 144 when the lifting seat 50 is in the elevating position shown in FIGS. 5 and 6. When so assembled, the lifting seat 50 is substantially parallel to the leveling frame 48 and comprises, in effect, a forward extension of it.

Each forwardly extending sprocket stop lever 152 is pivoted at its rear end for up and down movement about a pin 188 supported within the respective leveling frame channel member 142. The front ends of the stop levers have downwardly and forwardly inclined tongues 190 engageable between the teeth of the sprockets 62. As shown in FIG. 5, this inclination of each tongue prevents counterclockwise rotation but permits clockwise rotation of the sprocket. The cam 154 is circular and eccentrically mounted on a transverse rod 192 which is rotatably journaled between plates 146 of each leveling frame channel member 142. By swinging the offset handle 194 of the rod, the cam 154 can be moved from a down position shown in FIG. 5 where the stop lever blocks counterclockwise rotation of the sprocket, and the up position shown in FIG. 8 where the stop lever is elevated clear of the sprocket.

Two stabilizer legs 196, 196 are provided to prevent the wheelchair from tipping forwardly when the elevating apparatus is used. One leg is shown enlarged in FIG. 9. It comprises outer and inner telescopical tubes 198 and 200, respectively. Outer tube has a slot 202 on one side and a pair of holes 204 and 206 opposite the slot. The inner tube 200 has a pair of oppositely positioned holes through which a locking pin 208 extends. A spring 210 biases the pin inwardly. Each stabilizer leg is fastened in any suitable manner, for example, by a claim 199 to one of the curved tubes 42 at the front of the wheelchair. FIG. 9 shows one of the stabilizer legs in extended position engaging the floor 214, the pin 208 being engaged in the bottom hole 206. Alternatively, the user may grasp the head 212, disengage it from the hole 206, pull it upwardly to the retracted position shown in broken lines in FIG. 9, and reinsert the pin in hole 204. This will restore full mobility to the wheelchair.

When a user is seated on the lifting seat 50, he can work the hand levers 56 up and down to rotate ratchet wheels 60 and sprockets 62. As the sprockets climb the chains 52, the angle of tilt of the elevating frame 46 progressively increases. An important feature of this invention is that the loops 172 at the rear portions of the chains progressively pay out and lengthen to compensate for the increasing tilt of the elevating frame. This keeps the leveling frame 48 and lifting seat 50 horizontal through the entire elevating range.

FIG. 8 shows releasable latch means 216 for holding the lifting seat 50 in an out of the way, stored position. This comprises a bracket 218 fastened by a bolt 220 to the underside of the lifting seat. A hooked end 222 engages a pin 224 carried on bracket 73 fastened to the tie bar 72. The hooked end is curved, enabling it to be displaced slightly upwardly (as permitted by slot 184) when the seat is released and allowed to swing downwardly and backwardly. The latch means is released simply by shifting the seat upwardly to disengage the hooked portion 222 from the latch pin 224.

Use and operation of the apparatus will now be described. If a wheelchair user slips or falls to the floor, he can re-seat himself using the present invention by the following procedure.

First, he maneuvers himself and the wheelchair close enough to reach the apparatus 20 stored beneath the wheelchair seat. At this stage, the wheelchair and elevating mechanism are in the position shown in FIGS. 4 and 8. The user grasps the heads 212 of pins 208 and sets the legs into their extended positions shown in solid lines in FIG. 9. He releases bracket 218 from latch pin 224 by shifting the lifting seat upwardly as permitted by the lost motion between elongated slots 184 and cross shaft 64. He rotates both cams 154 by turning handles 194; this pivots both sprocket stop levers 152 upwardly about pivot pins 188 disengaging their respective tongues 190 from sprockets 62. The elevating frame then drops by gravity to the floor. The user shifts the lifting seat rearwardly as permitted by slots 184 until the upwardly curved bracket rear end portions 186 are hooked beneath and behind leveling frame tie rod 144 as shown in FIG. 6. He extends hand levers 56 by rotating handles 134 to release handle threads 140 from the inner group of threads 130 on rods 128, slides the handles outwardly on the rods, and then re-engages the handle threads 140 with the outer group of threads 132 on the rod. Finally, he rotates cam handles 194 to return stop levers 152 to their lowered positions (FIG. 5) where their tongues 190 engage sprockets 62.

At this stage, the elevating apparatus is in the down and loading position shown in FIG. 2, ready for the user to shift onto the lifting seat 50 and elevate himself to the level of the wheelchair seat 26. Also, at this stage, the leveling frame channel members 142 have been pivoted about cross shaft 64 to positions parallel to and nested without elevating frame channel members 68.

The user now scoots himself backwardly into a seated position on the lifting seat 50. From the FIG. 2 position, he lifts himself by working levers 56 up and down. Downward movement of either lever rotates cross shaft 64 through the corresponding pawl and ratchet pair 58 and 60, causing sprockets 62 to rotate and climb the chain 52 toward the suspension bar 54. Note that, because of the angle of tongues 190 in the stop levers 152, they act as pawls, locking the sprockets from counterclockwise rotation and preventing the elevating frame from dropping between lifting strokes of the handles. This progressively tilts the elevating frame upwardly about the axis of stub shafts 76 until it reaches the full upward position shown in FIGS. 3 and 5. As the elevating frame 46 tilts upwardly in this manner, the loops 172 in the rear end portions of the chains progressively lengthen to the positions shown in FIG. 5. The dimensions and proportions of the chains and elevating and leveling frames are determined so the lengthening of the chain loops 172 matches the shortening of the chain between the sprockets 62 and the suspension bar 54. The lifting seat 50 therefore remains horizontal throughout the entire lifting range between the FIG. 2 and FIG. 3 positions.

Figure 3:
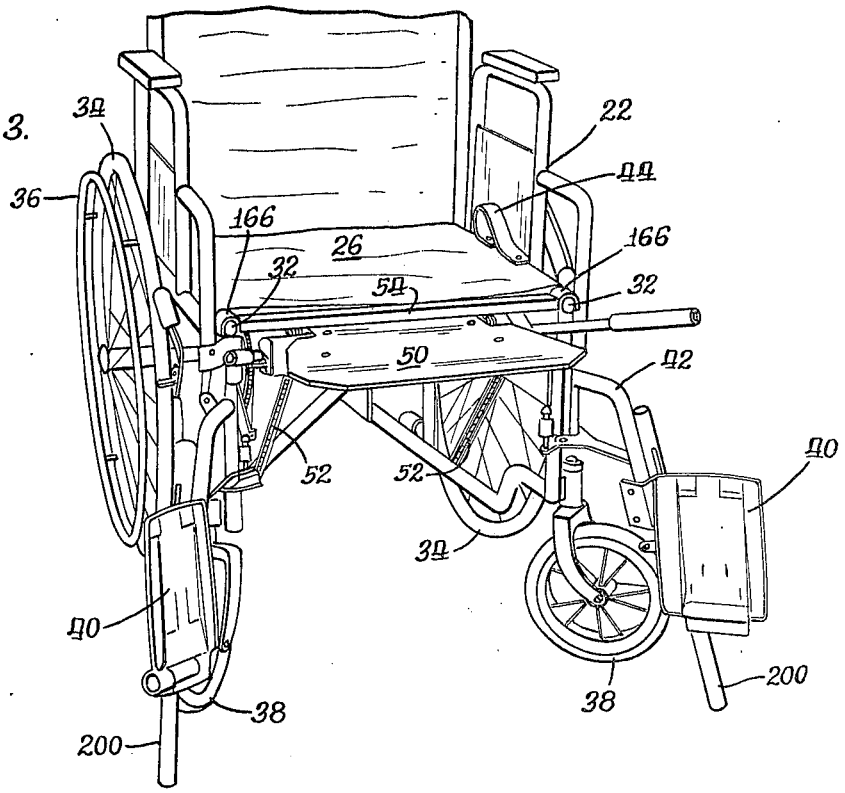
FIG. 3 is a view similar to FIG. 2 with the elevating apparatus shown in raised position with the auxiliary, lifting seat at the same height as the wheelchair seat.

When the user reaches the elevated position shown in FIGS. 3 and 5, it is easy for him to move backward into the wheelchair seat. Then, by raising the front edge of the lifting seat 50 slightly to unhook the rear bracket edges 186 from tie rod 144, and pulling it slightly forwardly, he releases it allowing it to swing downwardly and backwardly to the position shown in FIG. 8 where it is held in stored position by the latching mechanism 216. He rotates handles 134, returning them to the shortened position shown in solid lines in FIG. 7. By turning the handles inwardly a slight extra amount to move their flanges 136 into the broken line position shown in FIG. 7, they displace plunger pins 118 causing the pawls 58 to rotate to their broken line positions clear of the ratchet wheels 60. The handle levers 56 thendrop by gravity into out of the way, vertical, stored positions beneath the wheelchair seat. By reaching forwardly and downwardly, the user releases the stabilizer leg lock pins 208 and lifts them into the upper holes 204, thereby restoring the stabilizer legs to their retracted positions so they will not interfere with movement of the wheelchair. At this stage, the wheelchair is again fully mobile with the elevating apparatus 20 in out of the way, stored position beneath the wheelchair seat as shown in FIGS. 4 and 8.

The above embodiment has been necessarily specific for purposes of illustration. Alterations, extensions and modifications of this apparatus will be obvious to those skilled in the art.

The embodiments of the invention in which an exclusive property or privilege is claimed are defined as follows:

1. In a wheelchair having a main frame with wheels on opposite sides and a seat, user-elevating apparatus storable in the space between the wheels and below the wheelchair seat comprising:

a forwardly extending elevating frame pivoted at the rear of the main frame for up and down tilting movement about a transverse horizontal axis relative to the main frame;

a rearwardly extending leveling frame pivoted at the forward end of the elevating frame for up and down tilting movement about a transverse horizontal axis relative to the elevating frame;

a substantially horizontal user-lifting seat supported at the front of the leveling frame;

manually movable lifting lever means located on one of said frames readily accessible to a user on the lifting seat;

means responsive to movement of the lifting lever means to lift the elevating frame; and means responsive to movement of the elevating frame to tilt the leveling frame relative to the elevating frame and thereby maintain the lifting seat in a substantially horizontal position throughout a range of movement between floor level and the wheelchair seat level.

2. In a wheelchair, apparatus according to claim 1 in which said lifting seat is pivotally supported on the leveling frame for movement between a horizontal use position extending forwardly beyond the wheelchair seat, and a depending, stored position beneath the wheelchair seat.

3. In a wheelchair, apparatus according to claim 2 in which releasable latch means acting between the lifting seat and one of the frames holds the lifting seat in the depending stored position.

4. In a wheelchair, apparatus according to claim 1 in which the means responsive to movement of the elevating frame to tilt the leveling frame comprises chain means connected at one end to the main frame and connected at the other end to one of the other two frames, said chain means having an intermediate portion trained across idler means supported on said other two frames.

5. In a wheelchair, apparatus according to claim 4 in which the means responsive to movement of the lifting lever means to lift the elevating frame comprises sprocket means engaging the chain means, said sprocket means being rotatable by the lifting lever means.

6. In a wheelchair, apparatus according to claim 5 in which pawl and ratchet means is provided between the lifting lever means and sprocket means to enable rotation of the sprocket means by alternate up and down motions of the lifting lever means while the latter extends generally horizontally ahead of the wheelchair seat.

7. In a wheelchair, apparatus according to claim 6 in which said lifting lever means includes handle means which is manually rotatable and means for disengaging said pawl and ratchet means in response to rotation of the handle means to thereby enable the handle means to hang below the wheelchair seat in an out of way position when not in use.

8. In a wheelchair, apparatus according to claim 5 in which locking means is engageable with the sprocket means to lock the elevating frame and lifting seat against vertical movement, and manually operable means is provided to release said locking means to enable vertical movement of the elevating frame and lifting seat.

9. In a wheelchair, apparatus according to claim 1 in which floor-engageable stabilizer legs are provided on both sides of the main frame and extend forwardly therefrom to prevent the wheelchair from tipping forwardly by the weight of a user on the lifting seat.

10. In a wheelchair, apparatus according to claim 9 in which the stabilizer legs have telescopical bottom end extensions which are movable between an extended position engaging the floor and a retracted position above the floor, and means locking said extensions optionally in either position.

11. In a wheelchair, apparatus according to claim 4 in which spring means is interposed between the elevating and leveling frames and biased to urge said elevating and leveling frames apart to thereby tension the chain means throughout the range of elevated positions of the lifting seat.

* * * * *